US008070389B2

(12) United States Patent
Ayers et al.

(10) Patent No.: US 8,070,389 B2
(45) Date of Patent: Dec. 6, 2011

(54) MODULAR TOPSIDES SYSTEM AND METHOD HAVING DUAL INSTALLATION CAPABILITIES FOR OFFSHORE STRUCTURES

(75) Inventors: Thomas Ray Ayers, Houston, TX (US); Terje W. Eilertsen, Houston, TX (US); Jon Percle, Kingwood, TX (US); Viswanathan Balakrishnan, Katy, TX (US)

(73) Assignee: Technip France, Courbevoie (FR)

( * ) Notice: Subject to any disclaimer, the term of this patent is extended or adjusted under 35 U.S.C. 154(b) by 245 days.

(21) Appl. No.: 12/483,114

(22) Filed: Jun. 11, 2009

(65) Prior Publication Data

US 2010/0316449 A1 Dec. 16, 2010

(51) Int. Cl.
*E02B 17/00* (2006.01)

(52) U.S. Cl. ..... 405/204; 405/209

(58) Field of Classification Search ..... 405/195.1, 405/203, 204, 205, 206, 209
See application file for complete search history.

(56) References Cited

U.S. PATENT DOCUMENTS

| | | | | |
|---|---|---|---|---|
| 4,249,618 | A | 2/1981 | Lamy | |
| 4,744,697 | A * | 5/1988 | Coppens | 405/204 |
| 5,403,124 | A * | 4/1995 | Kocaman et al. | 405/209 |
| 5,800,093 | A * | 9/1998 | Khachaturian | 405/204 |
| 5,829,919 | A * | 11/1998 | Heerema | 405/209 |
| 5,924,822 | A * | 7/1999 | Finn et al. | 405/209 |
| 6,171,028 | B1 * | 1/2001 | Van Gelder | 405/209 |
| 6,299,383 | B1 * | 10/2001 | Finn et al. | 405/209 |
| 6,318,931 | B1 * | 11/2001 | Khachaturian | 405/204 |
| 6,347,909 | B1 * | 2/2002 | Kocaman | 405/209 |
| 6,364,574 | B1 * | 4/2002 | Khachaturian | 405/204 |
| 6,540,441 | B1 * | 4/2003 | Foss et al. | 405/209 |
| 6,648,553 | B2 * | 11/2003 | Rolfsnes | 405/209 |
| 6,736,571 | B2 * | 5/2004 | McCarthy et al. | 405/209 |
| 6,840,713 | B1 * | 1/2005 | Schia et al. | 405/209 |
| 2006/0157275 | A1 | 7/2006 | Kadaster et al. | |
| 2010/0074691 | A1 * | 3/2010 | Maher et al. | 405/195.1 |

FOREIGN PATENT DOCUMENTS

| | | |
|---|---|---|
| AU | 2009100098 | 4/2009 |
| EP | 0 001 462 | 4/1979 |
| GB | 2 259 536 | 3/1993 |
| WO | 2008/073815 | 6/2008 |

OTHER PUBLICATIONS

Vermeulen, T., International Search Report for International Patent Application No. PCT/US2010/037569, European Patent Office, dated Dec. 27, 2010.

Vermeulen, T., Written Opinion for International Patent Application No. PCT/US2010/037569, European Patent Office, dated Dec. 27, 2010.

* cited by examiner

*Primary Examiner* — Frederick L Lagman
(74) *Attorney, Agent, or Firm* — Locke Lord LLP

(57) ABSTRACT

The present disclosure provides an improved method and system for loading a topsides onto an offshore structure by functional modules. A module support frame forms a supporting structure to which production modules can be assembled. The production modules are adapted to extract or process hydrocarbons from a hydrocarbon well in an offshore location. One production module is a well bay production module to which other production modules can be coupled, including a drilling support production module, separation production module, export module, and utility module. The module support frame can be loaded onto floating barges and other modules assembled thereto to allow the barges to provide incremental and controlled support during the loading process and for the floatover installation. The barges can be floated out to the offshore structure and loaded onto the offshore structure by methods including a floatover method or with a heavy-lift crane vessel.

16 Claims, 5 Drawing Sheets

MODULAR TOPSIDES SYSTEM AND METHOD HAVING DUAL INSTALLATION CAPABILITIES FOR OFFSHORE STRUCTURES

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

This disclosure relates a system and method of installing a topsides on an offshore structure. More specifically, the disclosure relates to a system and method for installing modules by lifting or by a floatover technique onto an offshore structure, such as a Spar.

2. Description of the Related Art

Many offshore structures require a topsides to provide support facilities to operate the offshore structures for their intended purpose. For example, a Spar platform is a type of floating oil platform typically used in very deep waters and is among the largest offshore platforms in use. A Spar platform includes a large cylinder or hull supporting a typical rig topsides. The cylinder however does not extend all the way to the seafloor, but instead is moored by a number of mooring lines. Typically, about 90% of the Spar hull is underwater.

Deck or topsides installation has always been a challenge for floating structures, particularly in deep draft floaters such as the Spar, which must be installed in relatively deep water. In the past, topsides for most of previous floating structures and particularly, Spar platforms, were installed by heavy lift derrick barges in single or multiple module lifts ranging from about 3000 MT (metric ton) to over 30000 MT. There are some disadvantages in a lifted installation, particularly for large topsides requiring multiple module lifts. In traditional efforts, the topsides requires multi-lifting, for example five to seven lifts, to install the whole topsides due to the lifting capacity of available heavy lifting vessels. Such multi-lifts increase the costs and time for installing the topsides to the offshore structure.

As the offshore industry has matured and deeper wells are drilled, the needs of the industry have changed. There is significant market pressure to provide larger and more sophisticated topsides to meet the current demands of customers. One logical solution is to build larger and heavier capacity derrick barges for handling such massive topsides, despite the expense.

Floatover methods offer an alternative to the heavy left derrick barges. In general, one or more barges are loaded with a topsides near land and floated to the offshore structure, where the barge(s) or the offshore structure is ballasted so that the topsides can be transferred from the barge to the offshore structure. In some applications, a single barge is used that can be floated between support structures, the barge is ballasted and lowered in the water to allow the topsides to be fastened to the support structures. Recently, catamaran float-over systems have been used to install a topsides onto a Spar hull and other offshore structures. A catamaran float-over method is a concept in which the topsides is loaded onto at least two separated float-over barges to form a catamaran system and transported with the float-over barges to the installation site for the Spar hull. At the installation site, the float-over barges are positioned on both sides of the Spar hull with the Spar hull below the topsides, the elevation is adjusted between the topsides and the Spar hull, as the topsides is installed to the Spar hull.

However, as customers demand larger offshore topsides, the ability to load the massive topsides onto the barges as the topsides is pushed onto the barges, and the ability of the barges to float such topsides to the installation site is becoming more difficult. One solution is to build larger and heavier capacity barges and cranes.

A related, but more insidious, challenge is the assembly and planning required for such massive sizes. For example, at present, there is about a three-year waiting period for availability of offshore heavy lifting barges and equipment. Thus, scheduling of a lift is done often before even the topsides design is complete and certainly before the topsides is built that usually includes design changes. If the topsides is delayed through unavailability of components or other causes, then the window of the scheduled lift date that was predicted possibly three years in advance can be missed. Missing the scheduled date can cause a significant impact on the final completion of the project, because a new suitable installation window can be hard to obtain. Further, the design of the topsides is in some aspects dependent on the type of lifting method used—heavy lift or floatover. By an early commitment of an installation method, the associated cost is very dependent on market predictions and availability for activities two to three years into the further. Thus, the lift scheduling and the interdependent topside design imposes a large risk for the cost and completion schedule.

Further, the topsides is generally assembled and commissioned onshore, before it is installed by the heavy lifting or floatover methods onto the offshore platform. Thus, the use of the topsides on the offshore platform is dependent upon the completion of the entire topsides, even if certain functions of the topsides could be used in an early stage. The onshore assembly and related steps increase efficiency and reduce overall costs compared to assembling each component on the offshore platform. However, the onshore assembly and other steps cause this inflexibility and delay of use.

There remains then a need for an improved system and method of loading a topsides onto an offshore platform that is more efficient and flexible than current methods, while allowing the topsides to enjoy the benefits of onshore assembly.

BRIEF SUMMARY OF THE INVENTION

The present disclosure provides an improved method and system for loading a topsides onto an offshore structure by functional modules. The present disclosure allows the topsides installation by either lifting individual modules or groups of modules offshore using a heavy-lift crane vessel, or by preassembling one or more modules at nearshore or onshore and then transporting to the offshore site for a floatover installation to the offshore structure. Both these installation options are envisioned to be available for personnel until later stages of the design and fabrication of the topsides without being committed into any one of the installation options. A module support frame forms a supporting structure to which production modules can be assembled. The production modules are adapted to extract or process hydrocarbons from a hydrocarbon well in an offshore location. One production module is a well bay production module to which other production modules can be coupled, including a drilling support production module, separation production module, export module, and utility module. The module support frame can be loaded onto floating barges and other modules assembled thereto to allow the barges to provide incremental and controlled support during the loading process and for the floatover installation. The barges can be floated out to the offshore structure and loaded onto the offshore structure by methods including a floatover method or with a heavy-lift crane vessel.

The disclosure provides a modular topsides for an offshore structure, comprising: a module support frame constructed separate from the offshore structure, the frame comprising: a plurality of frame members extending laterally and adapted to receive a plurality of production modules that can be loaded thereon; and a plurality of support interfaces coupled to the frame members and adapted to be coupled to the offshore structure after the offshore structure is installed at an installation site; and the modular topsides further comprising at least one production module coupled with the module support frame, the at least one production module being adapted to extract or process hydrocarbons from a hydrocarbon well in an offshore location.

The disclosure provides a method of installing a topsides to an offshore structure, comprising: constructing a module support frame of a plurality of frame members extending laterally to receive a plurality of production modules; loading the module support frame onto a transportation barge; coupling a first production module adapted to extract or process hydrocarbons from a hydrocarbon well in an offshore location to the module support frame to form a topsides; transporting the module support frame and the first production module to the offshore structure; installing the module support frame onto the offshore structure; and installing a second production module to the module support frame.

DETAILED DESCRIPTION

Figure 1:
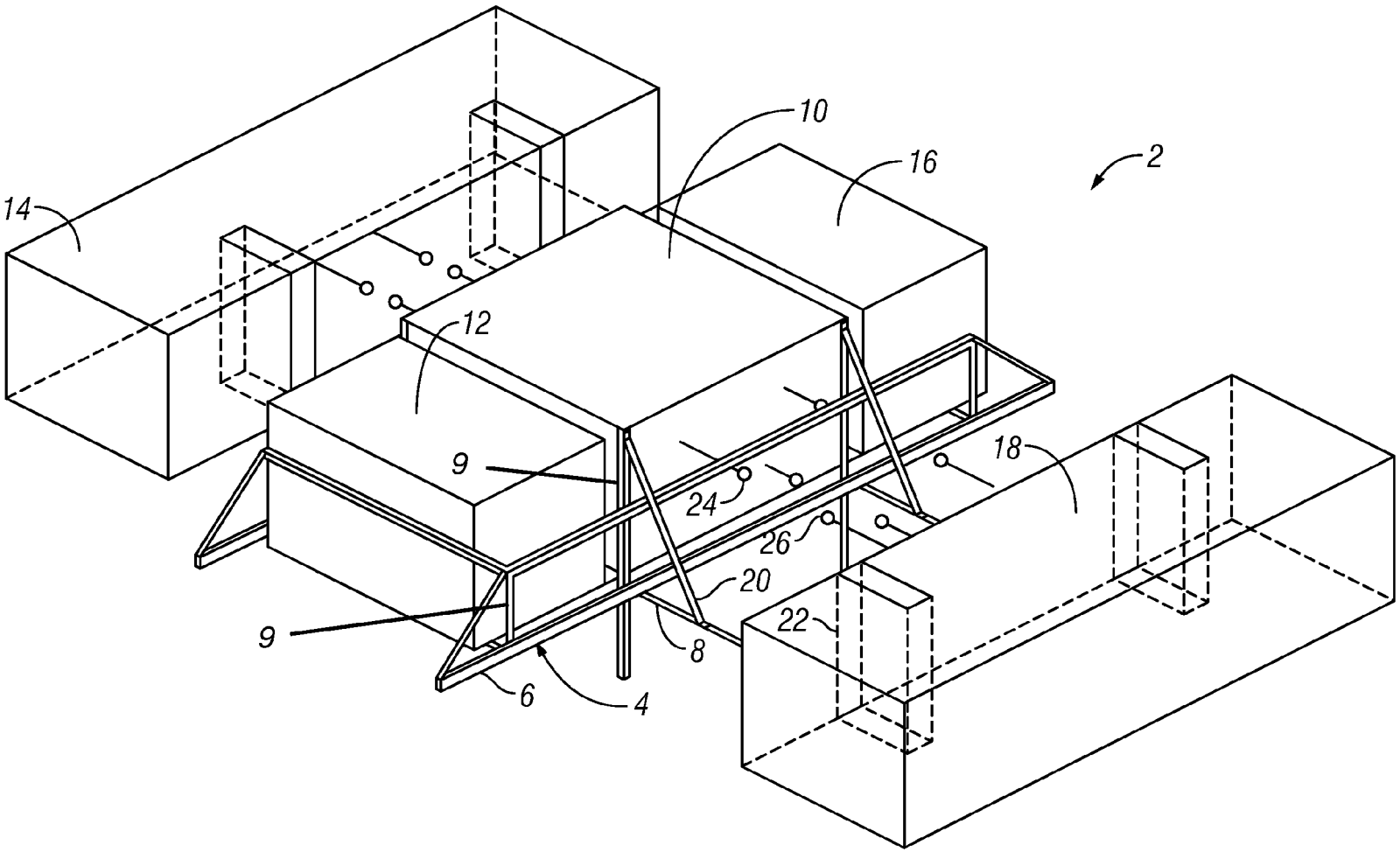
FIG. 1 is a schematic perspective view of an exemplary modular topsides with a module support frame and one or more production modules coupled thereto.

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present disclosure will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of ordinary skill in this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims. Where appropriate, elements have been labeled with an "a" or "b" to designate one side of the system or another. When referring generally to such elements, the number without the letter is used. Further, such designations do not limit the number of elements that can be used for that function.

In general, the present disclosure provides an improved method and system for loading a topsides onto an offshore structure by functional modules. A module support frame forms a supporting structure to which production modules can be assembled. The production modules are adapted to extract or process hydrocarbons from a hydrocarbon well in an offshore location. One production module is a well bay production module to which other production modules can be coupled, including a drilling support production module, separation production module, export module, and utility module. The module support frame can be loaded onto floating barges and other modules assembled thereto to allow the barges to provide incremental and controlled support during the loading process and for the floatover installation. The barges can be floated out to the offshore structure and loaded onto the offshore structure by methods including a floatover method or with a heavy-lift crane vessel.

FIG. 1 is a schematic perspective view of an exemplary modular topsides. The modular topsides 2 generally includes a module support frame 4 and one or more production modules 10, 12, 14, 16, 18. In general, the modular topsides 2 can include the modular support frame 4 and at least one production module 10. The module support frame 4 includes a plurality of frame members 6, 8, 9. In some embodiments, the frame members can be tubular components, solid components, plate components, or other structural components. Some frame members 6 can extend in a direction from side to side of the module support frame, such as in a cantilevered fashion. The frame members 6 can be used to support the modular topsides on one or more transportation barges described below. Further, the frame members 6 can be used to support one or more of the production modules. Similarly, the frame members 8 can extend in a direction between front and back, that is, in a different direction to the frame members 6. The frame members can also be used to support one or more of the production modules. Upright frame members 9 are shown coupled to the frame members 6, 8 or both, and form a vertical framework for restraining the modules therein.

For purposes herein, a "production module" includes a module of equipment and/or connections useful for extracting or processing hydrocarbons from a hydrocarbon well in an offshore location. The production module generally is designed to be built separate from the module support frame and loaded subsequent to its construction on the frame. The production module, where relevant, generally has one or more connections for interfacing with one or more of the other production modules. For example, the production modules 10, 12, 14, 16, 18 can be a well bay production module 10, a drilling support production module 12, a separation production module 14, and export production module 16, and a utility production module 18. Each of the modules has functions relative to production of hydrocarbons in an offshore structure. For most applications, the well bay production module will at least be included with most modular topsides. For example, the well bay production module can assist in handling manifolds, Christmas trees, blowout preventers, hangars, and other drilling and production equipment for the wellbore of the hydrocarbon well. The drilling support production module 12 can include tooling, supplies, electronics, monitoring equipment, and other facilities that support the drilling operation. A separation production module 14 can include equipment connections and other apparatus for separating the hydrocarbons from the well into various components, including water/oil/gas, flashing any unwanted gas, chemical injection equipment, and the like that are useful to those with ordinary skill in the art for separating the production hydrocarbons. An export production module 16 can include further processing equipment that prepares the hydrocarbons for shipping offsite, either into a tanker, or through gas lines and other conduits. A utility production module 18 can include one or more support facilities for the other production modules such as electrical generation, water supplies, chemical storage, and other utilities helpful in the operation of the topsides.

One or more support braces 20 of the module support frame 4 can be used to support the outwardly extending frame members 6, 8 and can be coupled to the upright frame members 9. However, one or more of the braces 20 interfere with the close coupling of the one or more production modules. To accommodate such bracing, one or more pockets 22 can be formed in one or more of the modules, such as module 18.

Depending on the nature and function of each of the modules, one or more connections from a module can be used to couple the functions of another module. For example, a connection 24 coupled to the well bay production module 10 can be used to couple to other connections in the other modules, such as connections 26 coupled to the utility production module 18. Such connections can include utility conduit and tubing, data transfer and control wires, and other connections that facilitate the functions of the various modules as an integrated system on the module support frame 4 of the modular topsides 2.

Figure 2A:
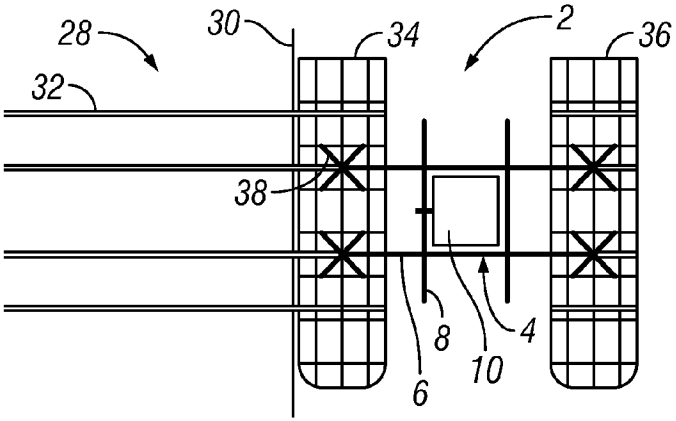
FIG. 2A is a schematic top view of a load out of the modular topsides with at least one module onto at least one transportation barge.
Figure 2B:
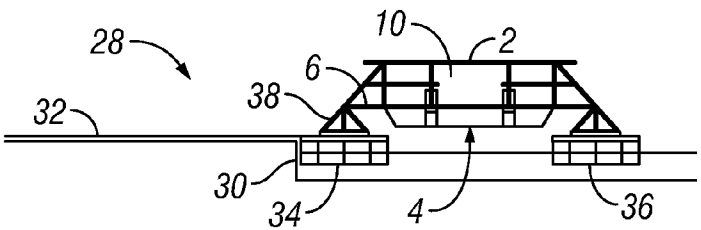
FIG. 2B is a schematic front view of the schematic shown in FIG. 2A.

FIG. 2A is a schematic top view of a load out of the modular topsides with at least one module onto at least one transportation barge. FIG. 2B is a schematic front view of the schematic shown in FIG. 2A. The figures will be described in conjunction with each other. As described above, the modular topside with the modular support frame and at least one production module can be fabricated onshore or near shore and then loaded onto one or more transportation barges. In the exemplary illustration of FIGS. 2A-3, two transportation barges are shown that are separated in a catamaran fashion. However, it is to be understood that such illustrations are merely exemplary and a single transportation barge can be used, two transportation barges side by side can be used, or three or more transportation barges can be used, depending on the size of the topsides, size and availability of barges, and installation method on the offshore structure. Thus, while the exemplary load out is described herein with the two catamaran barges, the general procedure is loading the frame and generally at least one production module onto at least one transportation barge.

A loading area 28 can be at the dock 30 or some other appropriate loading area. The loading area can include fabrication yards and offshore loading structures having the capacity to move the modular topsides from a relatively stationary facility to the barges. The embodiment will be described using a fabrication yard and dock for exemplary, but nonlimiting, purposes. Generally, the loading area 28 can include the fabrication yard as the module support frame 4 is constructed or can include a staging area which the module support frame 4 and any production module has been moved to prior to loading onto the transportation barges. The loading area 28 generally includes some type of loading structure 32 that can include rails or simply a support structure. The module support frame 4 can be pulled or pushed from the loading area 28 onto the one or more transportation barges, such as a first transportation bar 34 and a second transportation barge 36. Because the modular topsides 2 is generally constructed to be assembled in a modular form, it is possible and more probable that existing crane facilities at the loading area 28 can load the module support frame 4 and/or a production module onto the barges due to the reduced lifting weight of the frame and individual production modules. The module support frame 4 is generally supported on the barges by a grillage system 38 and coupled thereto with one or more sea fastening members (not shown). For example, the frame members 6 that extend in the first direction can extend between the two barges and be supported by the grillage system 38 coupled to the barges. Depending on the size and construction arrangements, the modular topsides 2 can initially include the module support frame 4 and a production module 10, coupled to the module support frame 4. Thus, the production module 10 and the module support frame 4 can be loaded onto the barges as an integrated system. Alternatively, the frame 4 can be loaded onto transportation barges, and then the production module 10 loaded to the frame. The reduced weight can be useful in loading the barges in such a manner that the barges can withstand even off-center loads that might not be possible with a typical, fully constructed, and assembled topsides as described above. Further, the module support frame and an optional production module can be loaded onto an intermittent barge and then loaded onto a catamaran barge arrangement, such as at a sheltered quayside location.

Figure 3:
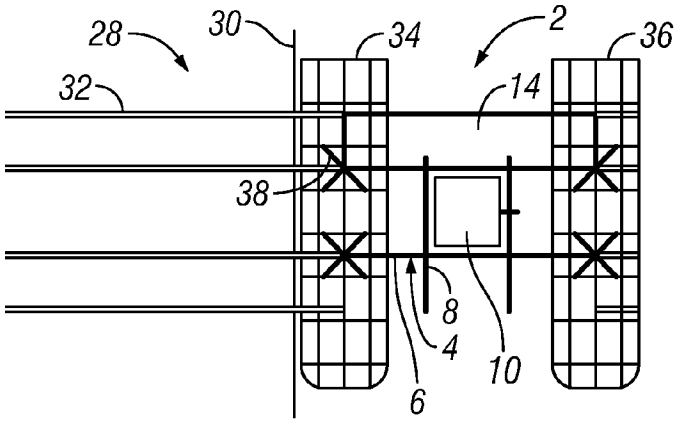
FIG. 3 is a schematic top view of the modular topsides shown in FIG. 2A with an additional module coupled to the module and/or module support frame shown in FIG. 2A.

FIG. 3 is a schematic top view of the modular topsides shown in FIG. 2A with an additional module coupled to the module and/or module support frame shown in FIG. 2A. In at least one exemplary method, after the module support frame 4 is supported by the barges 34, 36, then additional production modules can be loaded on to the module support frame in an incremental fashion. For example, the production module 14 can be loaded onto the module support frame and coupled with the frame and the production module 10. Thus, the weight distribution is progressively increased since the loading and weight is managed in a controlled fashion. Alternatively, one of more production modules can be loaded separately onto one or more other barges, and transported to the offshore structure to be loaded onto the module support frame 4, after the module support frame is coupled to the offshore structure. The modularity is useful for incrementally increasing the load to the offshore structure, as well as being able to incrementally manage smaller loads for the modular topsides in the lifting or otherwise floatover coupling of the modular topsides to the offshore structure.

Figure 4:
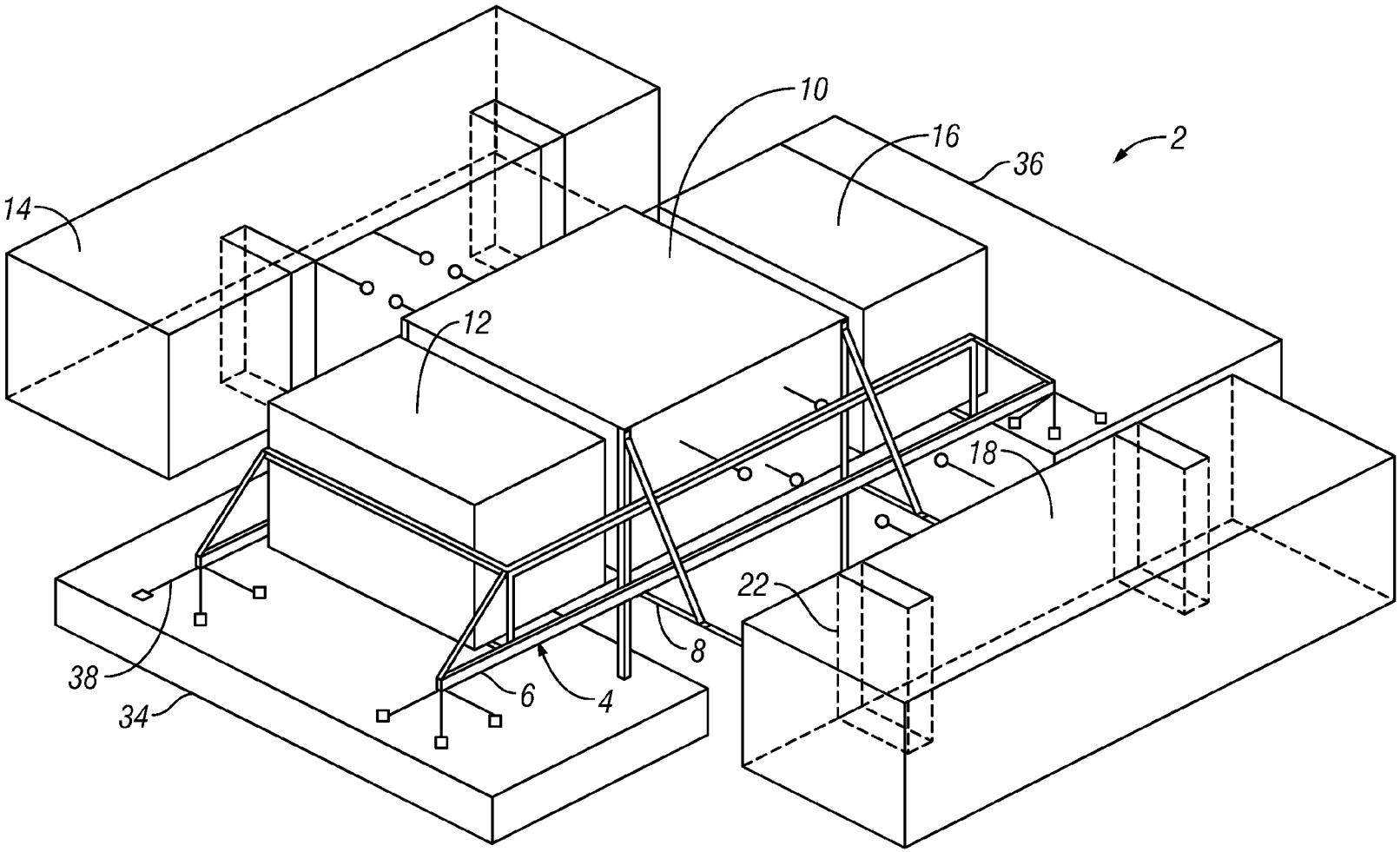
FIG. 4 is a schematic perspective view of an exemplary modular topsides loaded onto at least one transportation barges with other optional modules.

FIG. 4 is a schematic perspective view of an exemplary modular topsides loaded onto at least one transportation barges with other optional modules. The module support frame 4 with at least one production module can be loaded onto the barges 34, 36. Depending on the size and lifting or floatover capabilities, one or more of the other production modules can be loaded onto the module support frame 4 prior to transportation to the offshore structure. In general, it is expected that at least one production module will be included with the module support frame 4 on the barges. Further, it is understood that different arranges can be made of the various production modules installed on the barges or on the offshore structure. If the internal modular topsides with several of its production modules were assembled in incremental fashion to be loaded onto the barge, then in the exemplary system, the modular frame 4 would include the frame member 6 extending outwardly toward each of the barges, and being supported by the grillage system 38, as well as the frame members 8 extending in a direction different than the frame 6. The production module 18 could be coupled to the frame member and the production module 10 and be adapted to encompass the frame members 8 through a pocket 22. Another module 14, disposed distally from the production module 18, can be coupled to the module support frame 4 or any other applicable module on the module support frame 4. Likewise, the production module 12 and 16 can be coupled to the module support frame 4 and any other module as appropriate. Thus, the modular topsides 2 becomes an integrated unit of modules supported by the module support frame 4.

Further, the modular topsides 2 increase the flexibility of installation. For example, typically a topsides is fully constructed and fully tested prior to being loaded on the barges and floated to the installation site for the offshore structure. Such process can take years. However, often in the production needs of a hydrocarbon site, only limited resources are needed initially, and then as production is brought in further resources are needed. Thus, the modular topsides 2 can be deployed with limited resources that would generally include the modular support frame, the well bay production module 10, and perhaps the drilling support module 12 and the utility production module 18. Those modules can be loaded first as a modular topsides and installed on the offshore structure to begin drilling. As other modules are completed and needed, such modules can be brought to the offshore structure and installed on the modular support frame afterwards. Thus, the topsides can be used more flexibly and in a more expeditious fashion for the initial modules, while other modules are being designed, constructed, and completed.

Figure 5:
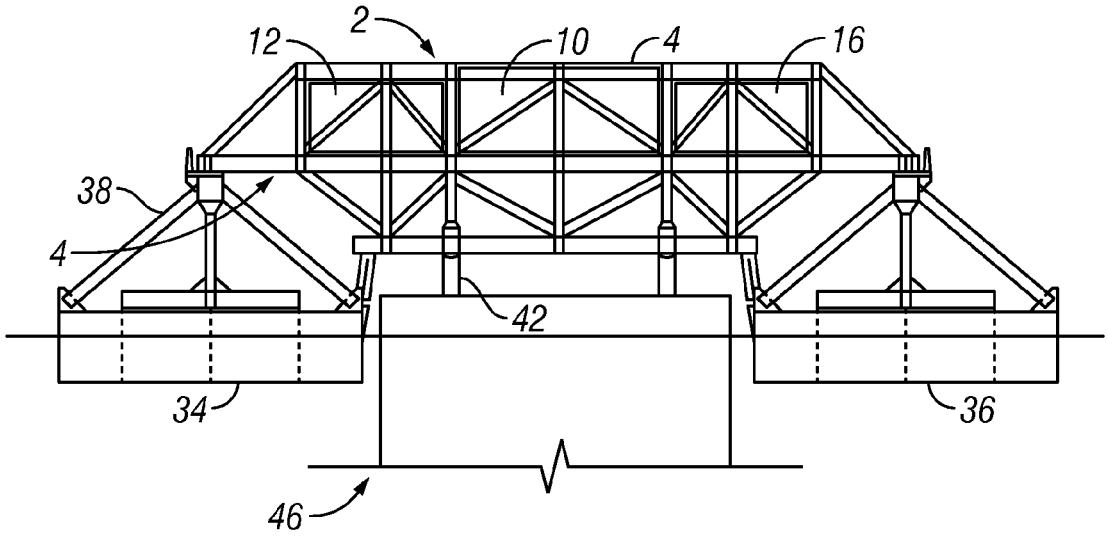
FIG. 5 is a schematic front view of the modular topsides being installed onto an offshore support structure.

FIG. 5 is a schematic front view of the modular topsides being installed onto an offshore support structure. In an exemplary installation procedure, the floatover barges 34, 36 can float over an offshore structure 46 when the offshore structure 46 is ballasted downwards to allow clearance. One or more vertical columns 42, generally referenced as support interfaces, are coupled with the modular support frame and can be used to couple the module support frame 4 and the production modules to the offshore structure 46. In some embodiments, the vertical columns 42 are adapted to be coupled to a deck of the offshore structure and to extend to an upper deck elevation of the topsides. Thus, the vertical columns can be used to support the frame and the production modules attached thereto to the offshore structure. As referenced above, one or more production modules, such as module 12 and/or module 16, can be coupled to the module support frame 4 during an initial installation or at a later time. After the vertical columns 42 are coupled to the offshore structure 46, the module support frame is disconnected or otherwise decoupled from the barges 34, 36 and any grillage system 38. The offshore structure 46 can then be deballasted and raised to provide clearance for the barges 34, 36 to be moved away from the installation site.

In other embodiments, such as suited for a heavy lift installation method by a heavy-lift crane vessel, the modular topsides can be loaded in individual modules on one or more barges with or without the module support frame loading onto the same or other barges. The one or more barges together or separately can be transported to the installation site and loaded onto the offshore structure by the heavy-lift crane vessel.

Figure 6A:
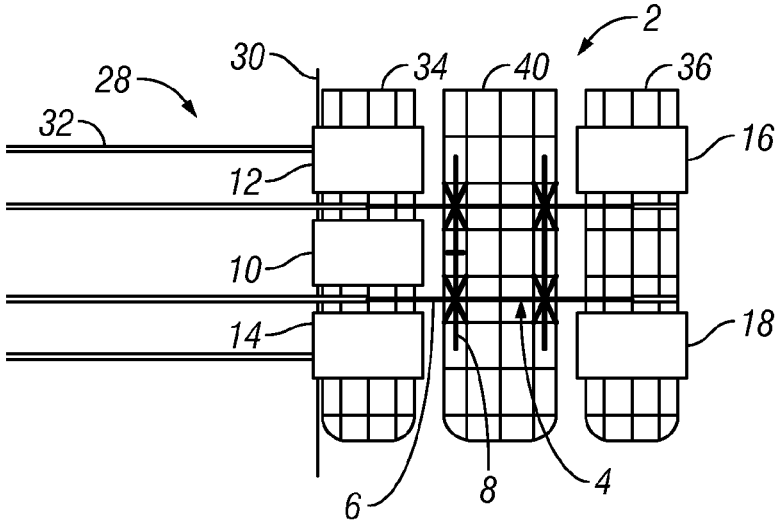
FIG. 6A is a schematic top view of a load out of the modular topsides onto at least one transportation barge.
Figure 6B:
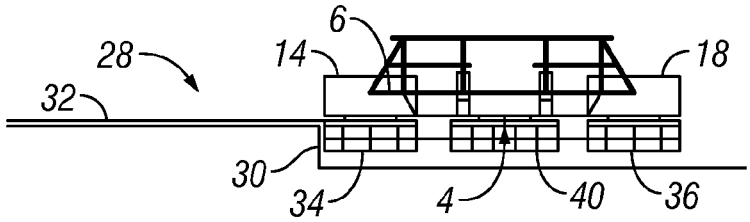
FIG. 6B is a schematic front view of the schematic shown in FIG. 6A.

FIG. 6A is a schematic top view of a load out of the modular topsides onto at least one transportation barge. FIG. 6B is a schematic front view of the schematic shown in FIG. 6A. The figures will be described in conjunction with each other. In some embodiments, especially suitable for heavy lifting, the modular topsides 2 can be loaded onto one or more barges for transportation to the installation site. For example, the module support frame 4 can be loading onto a barge 40. The production modules can be loaded onto other barges, as size and capacity of the barges may direct. The production modules 10, 12, and 14 can be loaded onto the barge 34. The production modules 16 and 18 can be loaded onto the barge 36. The barges can be transported together or separately and at separate times to the installation site.

Figure 7:
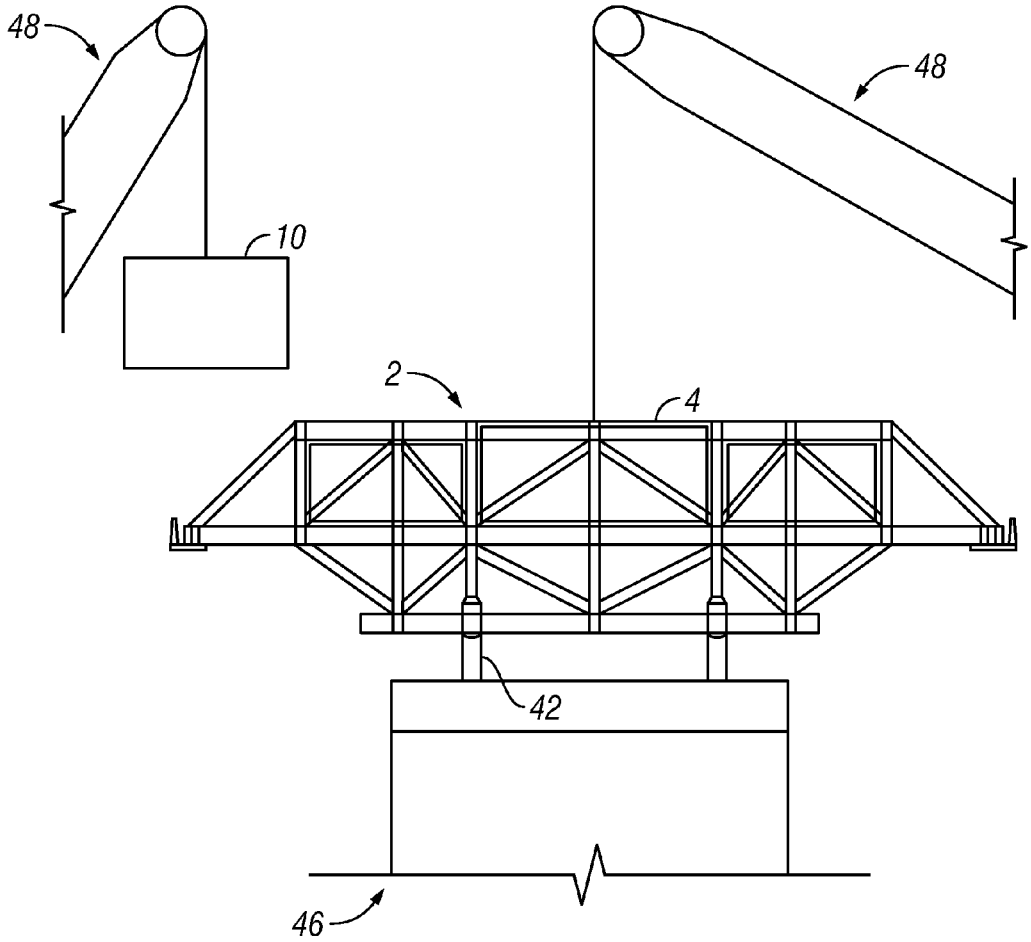
FIG. 7 is a schematic front view of the modular topsides being installed onto an offshore support structure with a heavy-lift crane vessel.

FIG. 7 is a schematic front view of the modular topsides being installed onto an offshore support structure with a heavy-lift crane vessel. At the installation site, the modular topsides 2 can be installed to the offshore structure 46. A heavy-lift crane vessel 48 can lift the module support frame 4 from the barge 40, shown in FIGS. 6A, 6B, and position the module support frame on the offshore structure 46. The vertical columns 42 can support the module support frame on the offshore structure. Other modules, such as a production module 10, can be installed with the heavy-lift crane vessel 48 to the module support frame 4 to form the modular topsides 2.

The modular topsides disclosed herein provides flexibility to the engineers and operators on selecting and/or committing to the particular installation method until a later time in the design process than is customarily allowable. Thus, engineering designs that affect the size, weight, positioning, and the like of the topsides components can be made with minimal disruption to the process. Such changes are sometimes excluded under current typical design constraints due to the changes being outside the limits and capabilities of an earlier commitment to a particular installation method that required designing to that method.

Other and further embodiments utilizing one or more aspects of the inventions described above can be devised without departing from the spirit of the disclosed invention. Further, the various methods and embodiments of the system can be included in combination with each other to produce variations of the disclosed methods and embodiments. Discussion of singular elements can include plural elements and vice-versa. References to at least one item followed by a reference to the item may include one or more items. Also, various aspects of the embodiments could be used in conjunction with each other to accomplish the understood goals of the disclosure. Unless the context requires otherwise, the word "comprise" or variations such as "comprises" or "comprising," should be understood to imply the inclusion of at least the stated element or step or group of elements or steps or equivalents thereof, and not the exclusion of a greater numerical quantity or any other element or step or group of elements or steps or equivalents thereof. The device or system may be used in a number of directions and orientations. The term "coupled," "coupling," "coupler," and like terms are used broadly herein and may include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and may further include without limitation integrally forming one functional member with another in a unity fashion. The coupling may occur in any direction, including rotationally.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range of equivalent of the following claims.

What is claimed is:

1. A modular topsides for an offshore structure, comprising:

a module support frame constructed separately from the offshore structure, comprising:

a plurality of frame members extending laterally and adapted to receive a plurality of production modules that can be loaded thereon;

a plurality of frame members extending uprightly and configured to form an upright framework to laterally restrain one or more of the production modules loaded therein;

at least one angular brace coupled between the frame members extending laterally and the frame members extending uprightly; and a plurality of support interfaces coupled to the frame members and adapted to be coupled to the offshore structure after the offshore structure is installed at an installation site;

at least one production module coupled with the module support frame, the at least one production module being adapted to extract or process hydrocarbons from a hydrocarbon well in an offshore location; and wherein the at least one production module includes a pocket formed in the module and is configured to be coupled to the module support frame with the at least one angular brace at least partially disposed within the pocket.

2. The modular topsides of claim 1, wherein the production module comprises a centrally disposed well bay production module.

3. The modular topsides of claim 1, wherein the frame members extend laterally outward from the production module and are adapted to be removably coupled to at least one transportation barge for a floatover installation on the offshore structure.

4. The modular topsides of claim 1, wherein the production module comprises a centrally disposed well bay production module and wherein the frame members extend laterally outward from the well bay production module and are adapted to allow one or more other production modules to be coupled to the well bay production module.

5. The modular topsides of claim 1, wherein the production module comprises a centrally disposed well bay production module;

the frame members extend laterally outward in a first direction from the production module and are adapted to be removably coupled to at least one transportation barge for a floatover installation on the offshore structure; and the frame members extend laterally outward in a second direction from the well bay production module, the second direction being different to the frame members in the first direction, the frame members being adapted to allow one or more other production modules to be coupled to the well bay production module.

6. The modular topsides of claim 1, wherein the support interfaces form vertical columns that are adapted to be coupled to a deck of the offshore structure and extend to an upper deck elevation of the topsides.

7. The modular topsides of claim 1, wherein the at least one production module comprise a well bay production module, a drilling support production module, a separation production module, an export module, and a utility module.

8. A system comprising:

the modular topsides of claim 1; and at least one transportation barge adapted to support the modular topsides.

9. A method of installing a topsides to an offshore structure, comprising:

constructing a module support frame of a plurality of frame members extending laterally to receive a plurality of production modules loaded thereon and extending uprightly and configured to form an upright framework to laterally restrain one or more of the production modules loaded therein;

bracing at least one of the frame members extending laterally with at least one of the frame members extending uprightly with an angular brace;

loading the module support frame onto a transportation barge;

coupling a first production module adapted to extract or process hydrocarbons from a hydrocarbon well in an offshore location to the module support frame to form a topsides, thereby installing a module with a pocket formed in the module and configured to be coupled to the module support frame with the angular brace at least partially disposed within the pocket;

transporting the module support frame and the first production module to the offshore structure;

installing the module support frame onto the offshore structure; and installing a second production module to the module support frame.

10. The method of claim 9, wherein installing the second production module to the module support frame occurs prior to installing the topside onto the offshore structure.

11. The method of claim 9, wherein the first production module comprises a centrally disposed well bay production module.

12. The method of claim 9, further comprising extending the frame members laterally outward from the first production module and removably coupling the module support frame to at least one transportation barge for a floatover installation on the offshore structure.

13. The method of claim 9, wherein the first production module comprises a centrally disposed well bay production module and further comprising extending the frame members laterally outward from the well bay production module and coupling the second production module to be the well bay production module.

14. The method of claim 9, wherein the first production module comprises a centrally disposed well bay production module and further comprising:

extending the frame members laterally outward in a first direction from the first production module;

removably coupling the frame members to at least one transportation barge for a floatover installation on the offshore structure;

extending the frame members laterally outward in a second direction from the well bay production module, the second direction being different to the frame members in the first direction; and coupling the second production module to the well bay production module.

15. The method of claim 9, further comprising supporting the module support frame with vertical columns to the offshore structure and extending the vertical columns to an upper deck elevation of the topsides.

16. The method of claim 9, further comprising installing the module support frame to the offshore structure by floating the module support frame over the offshore structure with at least one transportation barge, lifting the module support frame by a heavy-lift crane vessel from a barge to the offshore structure, or a combination thereof.

* * * * *